US011518484B1

(12) United States Patent
Uhde

(10) Patent No.: US 11,518,484 B1
(45) Date of Patent: Dec. 6, 2022

(54) WHEEL ASSEMBLY KIT FOR BOAT LIFT

(71) Applicant: Hewitt Machine & Mfg. Inc., Nicollet, MN (US)

(72) Inventor: Steve C. Uhde, Madelia, MN (US)

(73) Assignee: Hewitt Machine & Mfg. Inc., Nicollet, MN (US)

( * ) Notice: Subject to any disclaimer, the term of this patent is extended or adjusted under 35 U.S.C. 154(b) by 0 days.

(21) Appl. No.: 17/391,640

(22) Filed: Aug. 2, 2021

Related U.S. Application Data

(60) Provisional application No. 63/059,356, filed on Jul. 31, 2020.

(51) Int. Cl.
*B63C 3/06* (2006.01)
*B66F 9/075* (2006.01)

(52) U.S. Cl.
CPC ..... *B63C 3/06* (2013.01); *B66F 9/07509* (2013.01); *B66F 2700/123* (2013.01)

(58) Field of Classification Search
CPC ..... B63C 3/12; B63C 3/06; B63C 3/00; B66F 9/07509; B66F 2700/123
See application file for complete search history.

(56) References Cited

U.S. PATENT DOCUMENTS

| | | | | |
|---|---|---|---|---|
| 6,361,252 | B1 * | 3/2002 | Leitheiser | E02B 3/068 405/196 |
| 8,096,729 | B2 * | 1/2012 | Galik | B60P 3/1033 114/44 |
| 8,596,906 | B2 * | 12/2013 | Ebbenga | B63C 3/12 114/44 |
| 10,760,232 | B1 | 9/2020 | Uhde | |
| 2015/0328798 | A1 | 11/2015 | Miller et al. | |
| 2021/0229490 | A1 * | 7/2021 | Thompson | B63C 3/06 |

* cited by examiner

*Primary Examiner* — Andrew Polay
(74) *Attorney, Agent, or Firm* — DuFault Law Firm, P.C.; Dustin R. DuFault

(57) ABSTRACT

A wheel kit for use with a boat lift includes an upper member attachable to the boat lift, and a lower member slidably disposable within the upper member. The lower member contains an axle and a wheel assembly. A braking member includes a base plate with a first side and an opposing second side, a wedge portion outwardly extending from an upper end of the first side, and a tab outwardly extending from a lower end of the first side of the base plate. The braking member slidably disposes upon the axle via an aperture contained within the base plate. When positioning the lower member into the upper member to retract the wheel assembly, the wedge portion of the braking member contacts a closed terminal end of a slot contain within the upper member, outwardly urging the braking member against the wheel assembly to prevent rotation of the wheel assembly.

11 Claims, 7 Drawing Sheets

WHEEL ASSEMBLY KIT FOR BOAT LIFT

CROSS-REFERENCE TO RELATED APPLICATION

The present application claims a benefit of U.S. Provisional Application No. 63/059,356 filed Jul. 31, 2020, the contents of which are incorporated herein by reference.

BACKGROUND OF THE INVENTION

The present disclosure relates to boat lifts having retractable wheeled legs for transporting the boat lift in and out of water. More particularly, the present disclosure relates to a brake assembly connected to each leg to prevent the wheel from rotating when the leg, and thus the wheel, are positioned in an upright retracted position.

Boat lifts are known in the art as apparatuses that are placed in the water close to shore, especially near a dock, such that a boat can be floated thereover, and lifted out of the water when not in use. Placing the boat out of the water is a preferable way of storing the boat over extended periods of non-use, or to perform maintenance on the boat, without having to perform the extra work of entirely removing the boat out of the water via a boat trailer. However, the boat lift itself is sometimes required to be removed from the water. For example, in northern climates with freezing temperatures during the winter, it is often necessary to completely remove the boat lift from the water to avoid damage caused by freezing ice. To facilitate removal of the boat lift from the water, there exists in the art boat lifts having adjustable wheeled legs which allow the boat lift to be raised, supported by the wheels, and wheeled in and out of the water. When the boat lift is positioned in the water, the legs are retracted to position the wheel hub out of the water to prevent corrosion thereof. However, the tire of the wheel assembly, the lower portion of which is oftentimes in contact with the water, may still be allowed to rotate, urged by either the wind or lapping of waves. Over time, this rotation leads to mechanical wearing of the wheel's hub assembly, oftentimes requiring that the entire wheel assembly be replaced.

Attempts in the prior art have been made to prevent unwanted rotation of the wheel when in the retracted position. Such attempts, though, require use of a member protruding from, or near, the retractable leg, which can be obtrusive, especially when maneuvering the boat lift in and out of the water.

There therefore exists a need in the art to provide a non-obtrusive brake assembly to boat lifts having retractable wheeled legs which prevents movement of the wheel while in the retracted position.

BRIEF SUMMARY OF INVENTION

This present invention includes a brake device for braking a wheel of an extensible leg of boat lift device. The brake device slidably disposes upon an axle of a wheel assembly, wherein the axle is attached to an inner post contained within a lower member dock stanchion. When the wheel assembly, and axle, is positioned upwardly by retracting the lower member dock stanchion into an upper member dock stanchion, an inclined surface of the brake device eventually engages a top closed portion of a slot contained within the upper member dock stanchion. Further upward movement of the axle urges the brake device to slide outwardly upon the axle until the opposing side of the brake device engages a hub of the wheel assembly, thereby causing a frictional engagement preventing rotational movement of the wheel assembly. Upon lowering the wheel assembly, the inclined surface of the brake device disengages from the top close portion of the slot and the brake is naturally urged away from the wheel hub, whereupon disengaging therefrom, the wheel assembly is permitted to freely rotate.

BRIEF DESCRIPTION OF THE DRAWINGS

The following figures are used herein in conjunction with the written description to assist in understanding the invention. The Figures are as follows.

DESCRIPTION OF THE INVENTION

Figure 1:
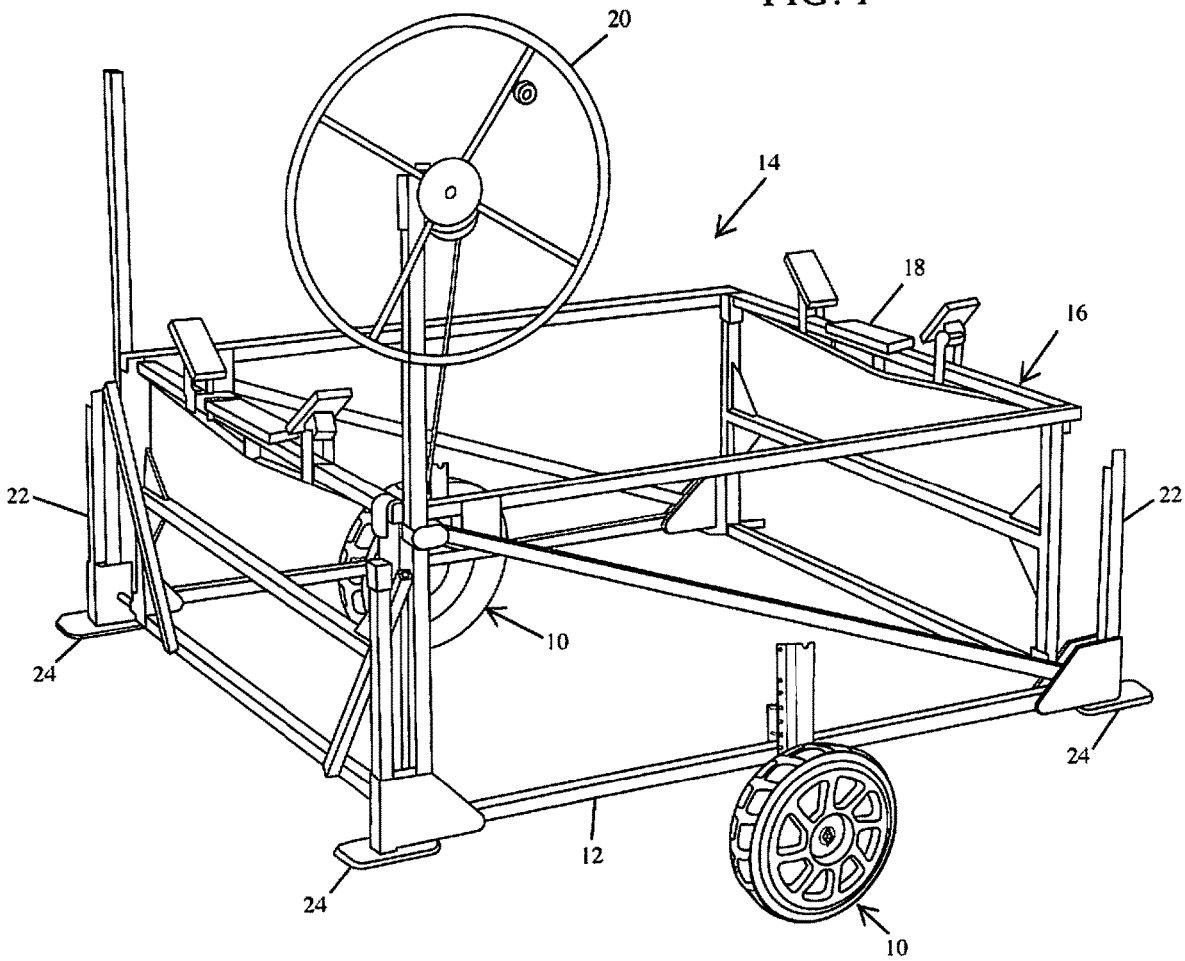
FIG. 1 is a perspective view of wheel kits attached to a boat lift in accordance with the present invention.

Referring to FIG. 1, wheel kit assemblies in accordance with the present invention are generally indicated at 10. Each wheel kit assembly 10 attaches to an opposing side of a support frame 12 of a boat lift 14. Boat lifts 14 are known in the art as devices placed in water, preferably near the shore or a dock, that lift and place a boat out of water when not in use. Boat lifts 14 provide a variety of advantages, including secure storage, damage prevention, and maintenance access. In addition to the support frame 14, a typical boat lift 14 will including a moveable carriage 16 upon which are positioned boat guides/supports 18 which secure a boat (not shown) in place during use. A fly wheel 20 is used to operate a lifting mechanism to raise and lower the carriage 16, thereby raising or lowering the boat in and out of the water. Adjustable legs 22, each with a foot 24, support the boat lift 14 when in water.

To facilitate transport of the boat lift 14, which may be needed to position the boat lift 14 in and out of the water, the adjustable wheel kit assembly 10 is provided. The wheel kit assembly 10 is attachable to the support frame 12 of the boat lift 14 by use of a bracket 26 and bolts 28. It should be noted that the wheel kit assembly 10 of the present invention is designed to be used with boat lifts from a variety of manufacturers, and the present disclosure is not directed to any particular boat lift 14 manufacturer.

Figure 3:
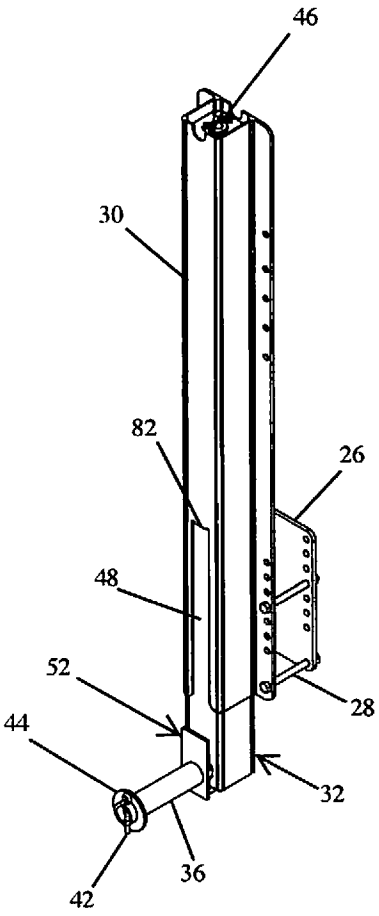
FIG. 3 is a perspective view of the wheel kit of FIG. 4 with a wheel assembly removed.
Figure 2:
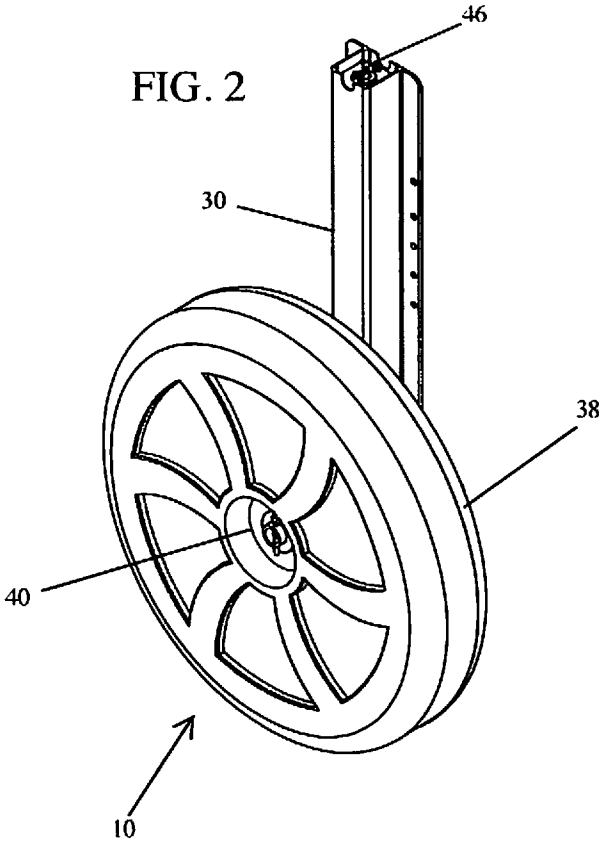
FIG. 2 is a perspective view of a wheel kit in accordance with the present invention.
Figure 4:
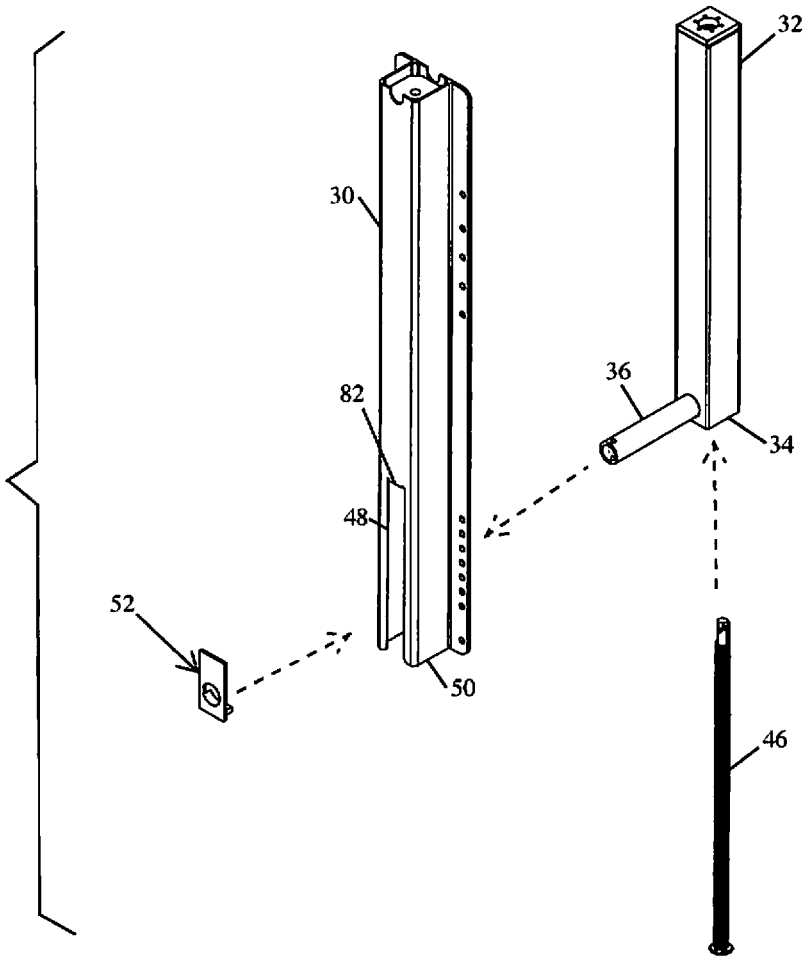
FIG. 4 is an exploded view of the wheel kit of FIG. 3.

As illustrated in FIGS. 2, 3 and 4, the wheel kit assembly 10 generally includes a tubular upper member 30 into which slidably disposes a tubular lower member 32. As such, the lower member 32 is sized to fit within the upper member 30. Positioned proximate a terminal end 34 of the lower member 32 is an axle 36, which extends generally perpendicular to the length of the lower member 32. A wheel assembly 38 connects to the lower member 32 by positioning an aperture 40 contained with a hub 41 of the wheel assembly 38 onto the axle 36. A cotter pin 44 and washer 46 are used to retain the wheel assembly 38 in place.

To selectively position the lower member 32 relative to the upper member 30, for instance, when raising or lowering the wheel assembly 38 relative to the boat lift 14, an adjustable screw 46 connects to the lower member 32 and threadably engages the upper member 30. Such a mechanism is similar to that as disclosed in commonly owned U.S. Pat. No. 10,760,232, the disclosure of which is incorporated herein by reference. However, other means of positioning the lower member 32 relative to the upper member 30 are well within the scope of the present invention. The upper member 30 further includes an elongated slot 48 extending upwardly from the bottom end 50. The slot 48 allows travel of the axle 36 when positioning the lower member 32 within the upper member 30, which would occur when retracting the wheel assembly 38 from the ground after transporting the boat lift 14 to a desired location. The slot 48 also contains, and permits slidable travel of, a braking device 52 positioned on the axle 36 between the wheel assembly 38 and the combination of the upper and lower members, 30 and 32, respectively.

Figure 6:
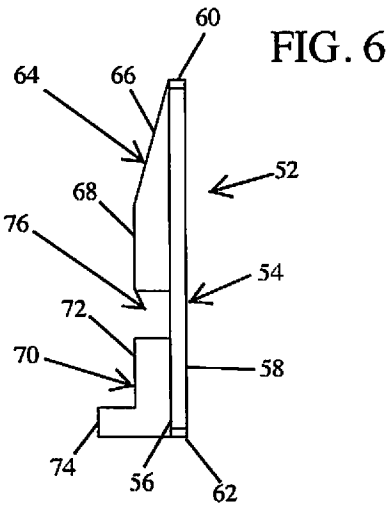
FIG. 6 is a side view of the brake device in the accordance with the present invention.
Figure 5:
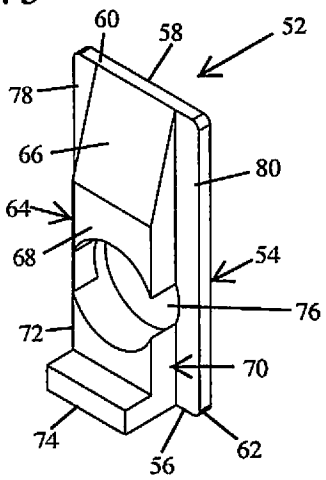
FIG. 5 is a perspective view of a brake device in accordance with the present invention.

As illustrated in FIGS. 5 and 6, the braking device 52 includes a base plate 54 having a first side surface 56, an opposing second side surface 58, as well as an upper end 60 and a lower end 62. Extending from the upper end 60 of the first surface 56 is a wedge portion 64. The wedge portion 64 includes an inclined surface, or face, 66 that lies in a plane at an angle relative to the plane of the first side surface 56 such that the wedge portion 64 has an increasing thickness as it extends from the upper end 60 towards the lower end 62 of the base plate 54. Positioned below the angled face 66, the wedge member 64 flattens, wherein a lower face 68 thereof lies in a plane parallel to the plane of the first side surface 56.

Opposite the wedge portion 64, a tab portion 70 extends from the lower end 62 of the first surface 56. The tab 70 is generally "L"-shaped in configuration, with an upper leg 72 lying in a plane parallel to the plane of the first side surface 56, and an outwardly extending lower leg 74 lying in a plane perpendicular to the plane of the first side surface 56. Positioned between the wedge portion 64 and the tab portion 70 is an aperture 76 extending through the base plate 54 from the first side surface 56 to the second side surface 58.

As illustrated in FIG. 5, the width of both the wedge portion 64 and the tab portion 70 is less than a width of the base plate 54, with both the wedge portion 64 and the tab portion 70 being centrally positioned on the first side 56 of the base plate 54. This results in a ledge 78, 80 being located on either side of the wedge portion 64 and the tab portion 70, with each ledge 78, 80 running the entire length of the base plate 54. As illustrated in FIG. 6, the second side 58 of the base plate 54 is a generally flat, planar surface. It is also noted that the braking device 52 is preferably machined from a unitary piece metal, but other suitable materials are well within the scope of the present invention.

Figure 7:
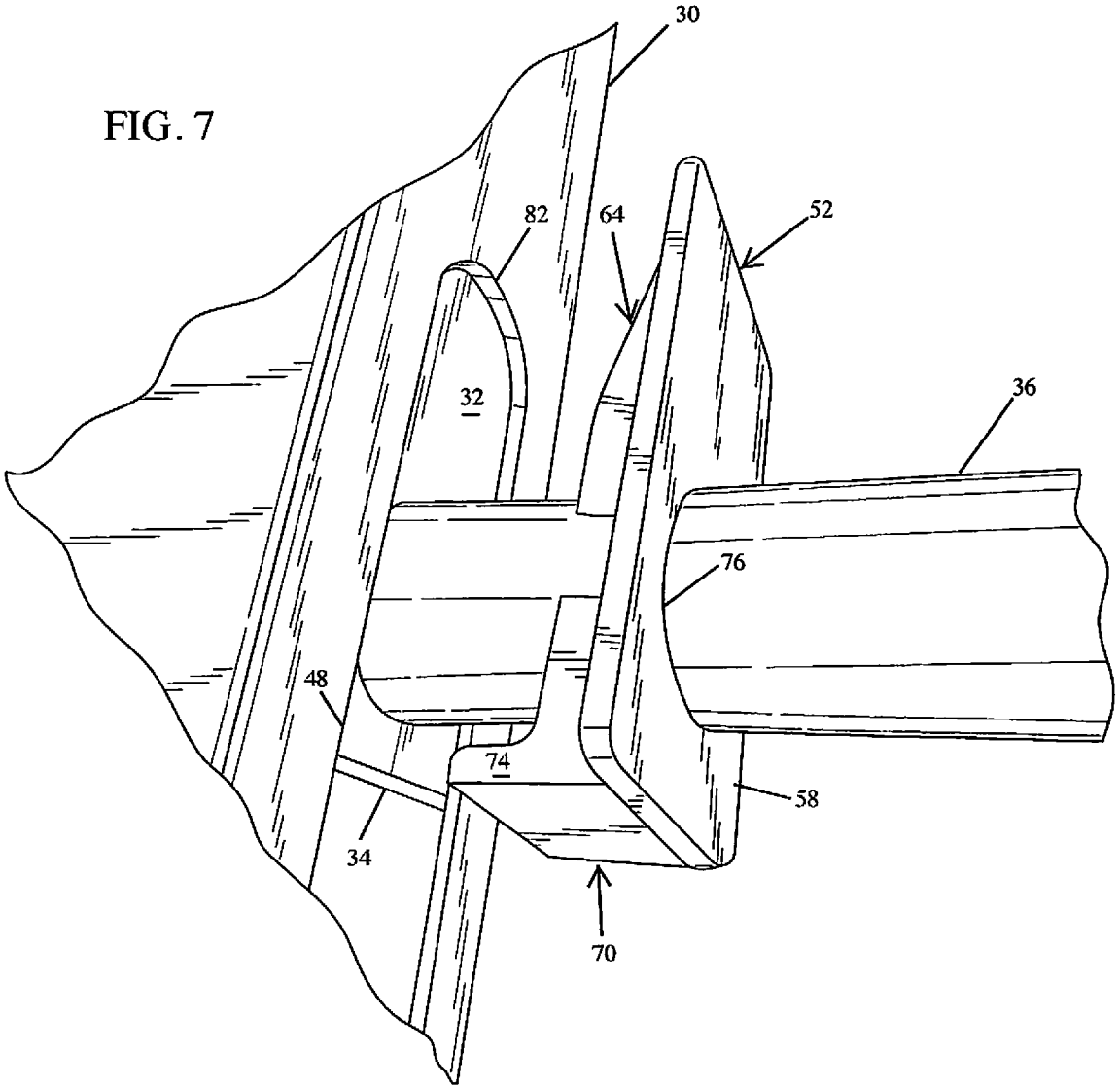
FIG. 7 is a partial perspective view of the brake device disposed upon an axle in accordance with the present invention.
Figure 8:
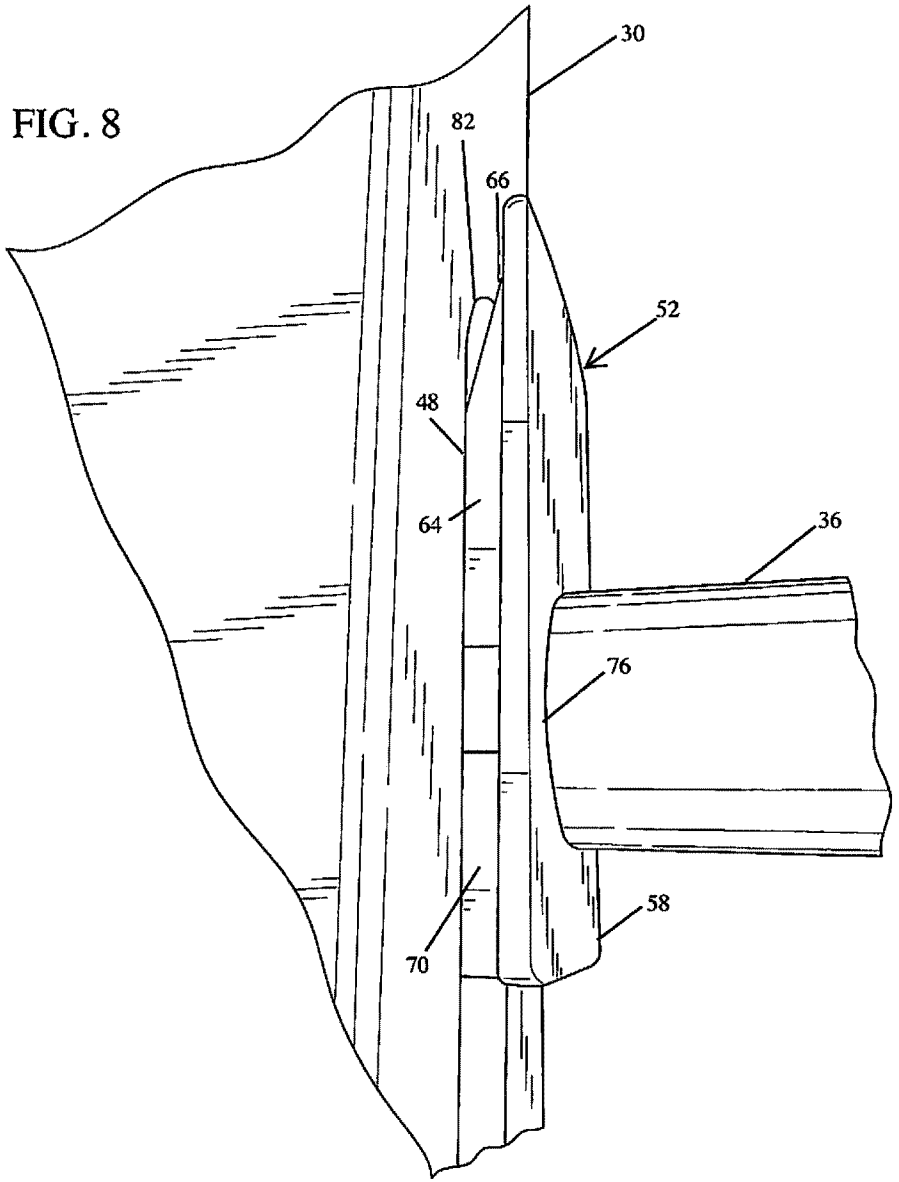
FIG. 8 is partial perspective view of the brake device disposed upon the axle and contained within a slot of an upper member in accordance with the present invention.

As illustrated in FIG. 7, the aperture 76 is sized so that the braking member 52 can slidably dispose upon the axle 36 extending from the lower member 32, with the first side surface 56, as well as the wedge portion 64 and tab portion 70, facing the lower member 32 disposed within the upper member 30. Further, the lower leg 74 of the tab portion 70 is configured to engage the bottom end 34 of the lower member 32. In that regard, and as illustrated in FIG. 8, both the wedge portion 64 and the tab portion 70 are configured to dispose within the slot 48 of the upper member 30, wherein rotational movement of the braking member 52 is not permitted. However, translational movement of the braking member 52 along the axle 36 is permitted, to a certain extent, as defined by the placement of the wheel assembly 38. Once the wheel assembly 38 is positioned onto the axle 36, with the cotter pin 42 installed to the lock the wheel assembly 36 in place, the amount of translational movement of the braking assembly 52 along the axle 36 is preferably limited to less than the amount of the lower leg 74 outwardly extending from the first side 56, such that both the wedge portion 64 and the tab portion 70 are at all times aligned within the slot 48 of the upper member. Further, inward movement of the braking device 52 within the slot 48 may be curtailed by the ledges 78, 80 contacting the upper member 30 proximate to the surfaces defined by the slot 48.

Figure 9:
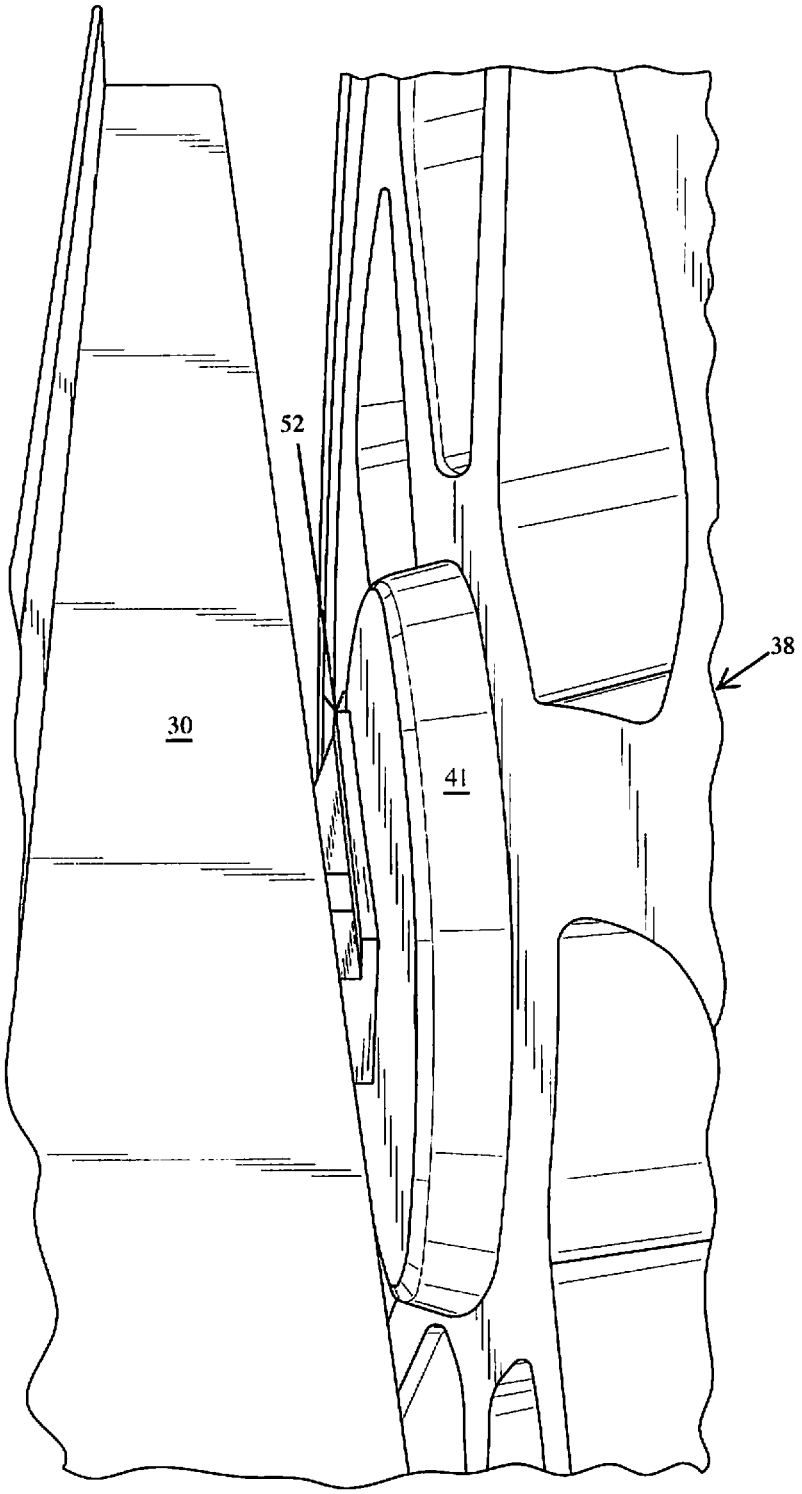
FIG. 9 is a partial perspective view of the brake device abutted against a hub of the wheel assembly in accordance with the present invention.

In operation, the wheel kit assembly 10 is positionable between a lowered position, wherein the boat lift 14 is lifted off its footings 24 and is allowed to be transported via the wheel assembly kits 10, as illustrated in FIG. 1, and a raised position, wherein the wheel assembly 38 of each kit 10 is brought to a raised position, and the boat lift 14 is secured by its own footings 24. In the course of bringing the wheel kit assembly 10 from the lowered position to the raised position, the lower member 32 is further disposed into the upper member 30, resulting in a portion of the axle 36 travelling within the slot 48 of the upper member 30. In so doing, the braking member 52 travels vertically with the axle 36 within the slot 48 as well. This travel continues unabated until the inclined surface 66 of the wedge portion 64 contacts a closed end 82 of the slot 48. After this initial contact of the wedge portion 64 with the closed end 82 of the slot 48, further upward travel of the axle 36, as would occur by further retracting the lower member 32 into the upper member 30, causes the braking member 52 to be urged outward along the axle 36 towards the wheel assembly 38. This outward urging continues, along with the upward travel of the axle 36, until the second flat surface 58 of the braking member 52 contacts the wheel assembly 38. Preferably, the second flat surface 58 contacts the hub 41 of the wheel assembly 38, as illustrated in FIG. 9. Upon such contact of the second side 58 of the base plate 54 with the wheel assembly 38, a frictional engagement occurs wherein the wheel assembly 38 is not permitted rotational movement, and is locked in place. While in this locked position, the wheel assembly 38 does not move by the force of wind or lapping water when the boat lift 14 is standing in water.

When the wheel assembly 38 is lowered, the downward traveling of the axle 36 causes the braking member 52 to travel downward as well. Eventually during this downward travel, the wedge portion 64 of the braking member 52 disengages from the closed end 82 of the slot 48, and the braking member 52 is allowed to travel inward along with axle 36, whereby the second surface 58 of the base plate 54 either disengages from the hub 41 of the wheel assembly 38, or alternatively if there remains contact, such contact is not enough to for a frictional engagement, thereby allowing the wheel assembly 38 to rotate freely.

It is recognized there are multiple variations beyond what are outlined in the detailed description to accomplish the objectives set forth by the current invention. Further alternative embodiments provide additional utility of the device for the convenience of the user. As such, although the present invention has been described with reference to preferred and alternative embodiments, workers skilled in the art will recognize that changes may be made in form and detail without departing from the spirit and scope of the invention.

The invention claimed is:

1. A wheel kit for use with a boat lift, the wheel kit comprising:

a tubular, upper member attachable to the boat lift, the upper member having a first end and a second end, the upper member containing surfaces defining an elongated slot extending from the second end toward the first end, the slot having a closed terminal end;

a tubular, lower member having a first end and a second end, the lower member sized such that the first end is slidably disposable within the upper member, the lower member having an axle extending perpendicularly from the second end;

a wheel assembly disposed upon the axle; and a braking member slidably disposed upon the axle between the wheel assembly and the second end of the lower member, the braking member comprising:

a base plate with a first side and an opposing second side, an upper end and a lower end;

a wedge portion outwardly extending from the upper end of the first side of the base plate;

a tab portion outwardly extending from the lower end of the first side of the base plate, wherein the wedge portion and the tab portion each have a width lesser than a width of the elongated slot; and surfaces defining an aperture for receiving the axle of the lower member, the aperture extending through the base plate between the wedge portion and the tab portion;

wherein the wedge portion and the tab portion slidably dispose within the slot of the upper member, wherein positioning the lower member into the upper member to retract the wheel assembly, the wedge portion of the braking member contacts the closed terminal end of the slot, outwardly urging the braking member against the wheel assembly to prevent rotation of the wheel assembly.

2. The wheel kit of claim 1 further comprising a mechanism to selectively position the lower member relative to the upper member.

3. The wheel kit of claim 2 wherein the mechanism to selectively position the lower member relative to the upper member comprises a threaded rod rotatably positioned within an interior cavity of the upper member, the threaded rod rotatably secured to the upper member, wherein the threaded rod is configured to threadably engage the lower member, wherein rotating the threaded rod causes the lower member to be selectively positioned relative to the upper member.

4. The wheel kit of claim 1 wherein the wheel assembly comprises a hub member, whereupon the wedge portion of the braking member contacting the closed terminal end of the slot, the second side of the base plate of the braking member is urged against the hub of the wheel assembly to prevent rotation of the wheel assembly.

5. The wheel kit of claim 1 wherein a width of the base plate is greater than a width of the elongated slot.

6. A wheel kit for use with a boat lift, the wheel kit comprising:

a tubular, upper member attachable to the boat lift, the upper member having a first end and a second end, the upper member containing surfaces defining an elongated slot extending from the second end toward the first end, the slot having a closed terminal end;

a tubular, lower member having a first end and a second end, the lower member sized such that the first end is slidably disposable within the upper member, the lower member having an axle extending perpendicularly from the second end;

a wheel assembly disposed upon the axle;

a mechanism to selectively position the lower member relative to the upper member in order to position the wheel assembly; and a braking member slidably disposed upon the axle between the wheel assembly and the second end of the lower member, the braking member comprising:

a base plate with a first side and an opposing second side, an upper end and a lower end;

a wedge portion outwardly extending from the upper end of the first side of the base plate;

a tab portion outwardly extending from the lower end of the first side of the base plate, wherein the wedge portion and the tab portion each have a width lesser than a width of the elongated slot; and surfaces defining an aperture for receiving the axle of the lower member, the aperture extending through the base plate between the wedge portion and the tab portion;

wherein the wedge portion and the tab portion slidably dispose within the slot of the upper member, wherein positioning the lower member into the upper member to retract the wheel assembly, the wedge portion of the braking member contacts the closed terminal end of the slot, outwardly urging the braking member against the wheel assembly to prevent rotation of the wheel assembly.

7. The wheel kit of claim 6 wherein the mechanism to selectively position the lower member relative to the upper member comprises a threaded rod rotatably positioned within an interior cavity of the upper member, the threaded rod rotatably secured to the upper member, wherein the threaded rod is configured to threadably engage the lower member, wherein rotating the threaded rod causes the lower member to be selectively positioned relative to the upper member.

8. The wheel kit of claim 6 wherein the wheel assembly comprises a hub member, whereupon the wedge portion of the braking member contacting the closed terminal end of the slot, the second side of the base plate of the braking member is urged against the hub of the wheel assembly to prevent rotation of the wheel assembly.

9. The wheel kit of claim 6 wherein a width of the base plate is greater than a width of the elongated slot.

10. A wheel kit for use with a boat lift, the wheel kit comprising:

a tubular, upper member attachable to the boat lift, the upper member having a first end and a second end, the upper member containing surfaces defining an elongated slot extending from the second end toward the first end, the slot having a closed terminal end;

a tubular, lower member having a first end and a second end, the lower member sized such that the first end is slidably disposable within the upper member, the lower member having an axle extending perpendicularly from the second end;

a wheel assembly disposed upon the axle, the wheel assembly having a hub member containing an aperture to receive the axle;

a mechanism to selectively position the lower member relative to the upper member in order to position the wheel assembly; and a braking member slidably disposed upon the axle between the wheel assembly and the second end of the lower member, the braking member comprising:

a base plate with a first side and an opposing second side, an upper end and a lower end;

a wedge portion outwardly extending from the upper end of the first side of the base plate;

a tab portion outwardly extending from the lower end of the first side of the base plate, wherein the wedge portion and the tab portion each have a width lesser than a width of the elongated slot; and surfaces defining an aperture for receiving the axle of the lower member, the aperture extending through the base plate between the wedge portion and the tab portion;

wherein the wedge portion and the tab portion slidably dispose within the slot of the upper member, wherein positioning the lower member into the upper member to retract the wheel assembly, the wedge portion of the braking member contacts the closed terminal end of the slot, outwardly urging the braking member against the hub member to prevent rotation of the wheel assembly.

11. The wheel kit of claim 10 wherein the mechanism to selectively position the lower member relative to the upper member comprises a threaded rod rotatably positioned within an interior cavity of the upper member, the threaded rod rotatably secured to the upper member, wherein the threaded rod is configured to threadably engage the lower member, wherein rotating the threaded rod causes the lower member to be selectively positioned relative to the upper member.

* * * * *